US011851922B2

(12) United States Patent
Major

(10) Patent No.: US 11,851,922 B2
(45) Date of Patent: Dec. 26, 2023

(54) DOOR STOPPER AND HOLDER DEVICE

(71) Applicant: Amélie Major, Montpellier (CA)

(72) Inventor: Amélie Major, Montpellier (CA)

( * ) Notice: Subject to any disclaimer, the term of this patent is extended or adjusted under 35 U.S.C. 154(b) by 0 days.

(21) Appl. No.: 17/957,170

(22) Filed: Sep. 30, 2022

(65) Prior Publication Data

US 2023/0108739 A1 Apr. 6, 2023

Related U.S. Application Data

(60) Provisional application No. 63/251,836, filed on Oct. 4, 2021.

(51) Int. Cl.

| | |
|---|---|
| ***E05C 17/50*** | (2006.01) |
| ***E05F 5/08*** | (2006.01) |
| ***E05F 5/06*** | (2006.01) |
| ***E05C 17/04*** | (2006.01) |
| ***E05C 17/46*** | (2006.01) |
| ***E05C 17/52*** | (2006.01) |

(52) U.S. Cl.

CPC ..... *E05C 17/50* (2013.01); *E05C 17/04* (2013.01); *E05C 17/46* (2013.01); *E05C 17/52* (2013.01); *E05F 5/06* (2013.01); *E05F 5/08* (2013.01)

(58) Field of Classification Search

CPC ..... E05C 17/08; E05C 17/44; E05C 17/443; E05C 17/46; E05C 17/48; E05C 17/50; E05C 17/505; E05C 17/52; E05C 17/04; E05F 5/06; E05F 5/08

See application file for complete search history.

(56) References Cited

U.S. PATENT DOCUMENTS

| | | | | | |
|---|---|---|---|---|---|
| 89,819 | A * | 5/1869 | Wagner | E05C 19/06 | 292/DIG. 19 |
| 245,082 | A * | 8/1881 | Massey | E05C 17/50 | 292/DIG. 19 |
| 318,323 | A * | 5/1885 | Teetzel | E05F 5/00 | 292/338 |
| 398,439 | A * | 2/1889 | Parsons | E05C 17/04 | 292/91 |
| 409,194 | A * | 8/1889 | Hardy | E05C 17/04 | 292/91 |
| 847,285 | A * | 3/1907 | Harris | E05C 17/443 | 292/210 |
| 1,344,647 | A * | 6/1920 | Newsom | E05C 17/50 | 292/121 |
| 1,347,048 | A * | 7/1920 | Mardaus | E05C 17/50 | 292/103 |

(Continued)

*Primary Examiner* — Jeffrey O'Brien
(74) *Attorney, Agent, or Firm* — PRAXIS

(57) ABSTRACT

A door stopper and holder device for a door and having a distal part for anchoring to a structure adjacent the door when in a door open position, and a proximal part movably mounting onto the distal part. The proximal part is movable between an operating configuration, in either stopper mode or holder mode with the proximal part either being in abutment with the door or capturing the door therewith in the door open position, respectively, and a switching configuration in which the proximal part allows the door to be moved relative to the device which switches between the stopper and holder modes of the operating configuration. A device axis is generally perpendicular to a door plane when the door is in the door open position.

16 Claims, 4 Drawing Sheets

(56) References Cited

U.S. PATENT DOCUMENTS 1,732,329 A * 10/1929 Dann ..... E05C 17/50 292/DIG. 19
1,795,983 A * 3/1931 Wesner ..... E05C 17/50 292/202
1,903,669 A * 4/1933 Greene ..... E05C 17/52 292/87
2,042,297 A * 5/1936 Craighead ..... E05C 17/52 292/87
2,704,220 A * 3/1955 Graham ..... E05C 17/443 292/338
2,976,071 A * 3/1961 Anderson ..... E05C 17/50 292/216
3,006,676 A * 10/1961 Germock, Jr. ..... E05C 17/443 16/86 A
4,134,608 A * 1/1979 Pool ..... E05C 17/52 292/DIG. 19
4,302,864 A * 12/1981 Morita ..... E05C 17/50 16/85
5,226,201 A * 7/1993 Lefebvre ..... E05C 17/52 292/87
5,465,460 A * 11/1995 Cantone ..... E05C 17/50 292/DIG. 19
5,490,304 A * 2/1996 Winner, Jr. ..... E05F 5/06 16/82
6,016,588 A * 1/2000 Kamerschen ..... E05C 17/52 16/85
6,584,642 B2 * 7/2003 Hodson ..... E05F 5/08 16/86 B
7,065,830 B2 * 6/2006 Bushey ..... E05C 17/54 16/85
10,501,968 B2 * 12/2019 Maher ..... E05C 17/08
11,371,272 B2 * 6/2022 Pesacov ..... E05C 17/047
11,473,354 B2 * 10/2022 Maher ..... E05C 17/24
2007/0266522 A1 * 11/2007 Li ..... E05F 5/06 16/82
2017/0321458 A1 * 11/2017 Cirilli ..... E05C 17/50
2018/0119473 A1 * 5/2018 Jensen ..... E05F 5/06
2019/0112850 A1 * 4/2019 D'Souza ..... E05C 17/54
2022/0042358 A1 * 2/2022 Gordon ..... E05C 17/52

* cited by examiner

DOOR STOPPER AND HOLDER DEVICE

CROSS-REFERENCE TO RELATED APPLICATIONS

The present application claims the benefit of U.S. provisional patent application No. 63/251,836, filed on Oct. 4, 2021, and which is incorporated herein by reference.

FIELD OF THE INVENTION

The present invention relates to door/window stopper devices, and more specifically to a combined door/window stopper and holder device.

BACKGROUND OF THE INVENTION

It is well known in the art of door stoppers to be able to hold the door in the open position whenever desired. These devices usually use magnets or the like to maintain the door in the open position and require a relatively small effort to release the door from the holder. Such doors can also be inadvertently released by a draught or after being hit by another object, or person or even a domestic animal (pet) passing nearby. After extended usage of these magnets, such systems could even lose their efficiency. Other devices require a hook-like member to selectively secure the door to the holder. All these devices always require a piece to be attached or secured to the door, thereby altering or affecting the integrity (at least the visual aspect thereof) or safety of the door, or damaging the door, by drilling and inserting a screw or the like into the door. A fire protection door should never be drilled into without knowing where it is possible to do so without affecting the efficiency of the safety of the door.

Door stoppers and holders such as wedges or the like do not always properly function and easily loose efficiency, as they might get dirty or slippery, depending on the type of the floor surface and/or the cleanliness of the surface. Such wedges also get in the way when they are not being used.

Furthermore, some well-known door stoppers are installed directly on the door and include a stopper member positioned against the door when not in use and that is rotated (or flipped down) to have an end contacting the floor to prevent the door from moving only in the direction toward the closed position. This stopper also has a tendency to lose efficiency over time, while also possibly damaging the floor over time, with markings or scratches.

Accordingly, there is a need for an improved door stopper and holder.

SUMMARY OF THE INVENTION

It is therefore a general object of the present invention to provide an improved door stopper and holder that obviates the above-mentioned drawbacks.

An advantage of the present invention is that the device does not alter or damage the original door, such that the door will always remain intact. Similarly, the floor will also remain intact. Nonetheless, in specific cases, the device could be secured or anchored to the floor.

Another advantage of the present invention is that the device can be installed as a replacement of an existing door stopper already installed on a wall (or on the floor), such as the usual spring door stop, thereby limiting the alterations or damages to a minimum, or simply eliminating such possible alterations or damages. In addition, no extensive tool (as electric tools) is required, other than a simple screwdriver or the like.

A further advantage of the present invention is that the device can be used as a door stopper to protect the door and more specifically the adjacent wall (when the door is in the open position) from being damaged by the door handle, and as a door holder to safely maintain the door in the open position adjacent to the wall to keep the door opening fully accessible whenever needed.

Yet a further advantage of the present invention is that the device can be installed similarly on any type of gates, such as doors or windows.

Still another advantage of the present invention is that the device can be installed adjacent to the bottom edge of the door (typically), when the door is in the open position, or the top edge, or even the free side edge, at any desired height to accommodate any special needs (like for handicapped people, people in wheelchairs, etc.).

Yet another advantage of the present invention is that the device has a movable part that is preferably at least partially rotatable, relative to a fixed part, to allow the selective capture of the door with the movable part or release of the door therefrom. Typically, the device may include a flexible and/or resilient member allowing the partial rotation and/or typically the tilting or flexion of the movable part. Alternatively, the movable part can be totally or freely rotatable relative to a fixed and rigid part, typically about an axis that is essentially perpendicular to the door when in the open position. Optionally, the flexible and/or resilient member can be a torsion/tension (extendable—as an extension spring) coil spring, similar to those used in conventional spring door stoppers. When the moving part is freely rotatable relative to the fixed part, the center of gravity of the moving part is adjusted to ensure that the moving part always returns into the operating configuration (stopper or holder mode), either using additional masses, counterweight, and/or different materials. This also allows for the device to be used/installed adjacent any free edge (or surface) of the door (bottom, top, or lateral side).

Still a further advantage of the present invention is that the device can be moved from its operating configuration (stopper mode), either using one's hand or foot, into its switching configuration to selectively capture the edge (or surface) of the door with the device, typically into a U-shaped or cradle form section thereof, or to release the door therefrom. In moving, the U-shape section is typically tilted down (when close to the bottom edge of the door) and rotated to allow the door edge to move over the U-shape section, and then released to return by resiliency (spring effect) to its operating configuration (holder mode) with the door safely retained therein. And vice-versa to release the door from the operating configuration (holder mode) back into the operating configuration (stopper mode), via the switching configuration.

A further advantage of the present invention is that the device has a door/window holder section which can be made adjustable in length to adjust to the door thickness, and/or in height to adjust for the height of the bottom edge (or surface) of the door relative to the floor surface (to safely ensure that the door is well retained within the holder section), depending on the gap between the door and the floor. Similarly, to suit the different needs, the specific shapes, materials and/or colors of the different pieces could be different from one device to the other, as it would be obvious to those skilled in the art. Similarly, the specific design of each component could ensure that the overall device would prevent occurrences of any accidental non-negligible or fatal injuries to a person or animal.

Yet a further advantage of the present invention is that the device provides safety, while being relatively easy to install and use.

According to an aspect of the present invention, there is provided a door stopper and holder device for operating with a door (including window, gate and the like) when in a door open position the door generally having a main body defining a door plane, the device comprising:

a distal part for anchoring to a structure adjacent the door when in the door open position; and a proximal part movably mounting onto the distal part;

wherein the proximal part being movable between an operating configuration, with a device axis being substantially perpendicular to the door plane when the door is in the door open position, in either stopper mode or holder mode with the proximal part being adapted to either be in abutment with the door or capture the door therewith in the door open position, respectively, and a switching configuration in which the proximal part is adapted to allow the door to be moved relative to the device which switches between the stopper mode and the holder mode of the operating configuration.

In one embodiment, the proximal part is rotatably mounting onto the distal part about the device axis, with the proximal part being rotatable between the operating configuration and the switching configuration.

Conveniently, the proximal part includes a door capturing section (cradle) having a proximal end adapted to be in abutment with the door when in the door open position.

In one embodiment, the door capturing section has a generally U-shaped body defining distal and proximal members both extending from a base member, the base member being generally spaced from the device axis, with both the distal and proximal members being substantially perpendicularly oriented relative to the device axis, the distal and proximal members receiving the door therebetween when in the operating configuration to releasably capture the door.

Alternatively, the proximal part is into an in-line position relative to the distal part when in the operating configuration, the device further comprising a flexible resilient member connecting to the distal part and biasing the proximal part into the in-line position, while allowing the door capturing section to be selectively displaced into an angled position relative to the device axis when in the switching configuration.

Conveniently, the flexible resilient member is connected to both the proximal and distal parts and is located therebetween.

Conveniently, the flexible resilient member is a torsion-coil spring having a coil axis being generally parallel to the device axis.

Conveniently, the torsion-coil spring allows the rotation of the proximal part relative to the distal part about the device axis.

Alternatively, the flexible resilient member is a torsion-coil spring having a coil axis being generally colinear with the device axis.

In one embodiment, the base member is generally parallel to the device axis, with both the distal and proximal members being substantially perpendicularly oriented relative to the base member.

In one embodiment, the U-shaped body is generally vertically oriented when in the operating configuration.

In one embodiment, the U-shaped body is adjustable in size.

Alternatively, the base member is adjustable in a length direction thereof so as to adjust a distance between the distal and proximal members.

In one embodiment, one of the distal and proximal members slightly extends away from the other one of the distal and proximal members when extending away from the base member.

Conveniently, the distal and proximal members slightly extend away from one another when extending away from the base member.

In one embodiment, the proximal part has a center of gravity offset from the device, the center of gravity maintaining the proximal part into the operating configuration about the device axis.

Conveniently, the center of gravity is vertically offset from and below the device axis.

Conveniently, the door capturing section is vertically in line with the device axis when into the operating configuration.

Alternatively, the door capturing section is further horizontally offset from the device axis when into the operating configuration.

In one embodiment, the proximal part is freely rotatably mounted onto the distal part about the device axis.

In one embodiment, the proximal part is into an in-line position relative to the distal part when in the operating configuration, the device further comprising a flexible resilient member connecting to the distal part and biasing the proximal part into the in-line position, while allowing the door capturing section to be selectively displaced into an angled position relative to the device axis when in the switching configuration, the flexible resilient member being a flexible bar member.

Conveniently, the proximal part is fixedly attached to the flexible bar member.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE INVENTION

Figure 1:
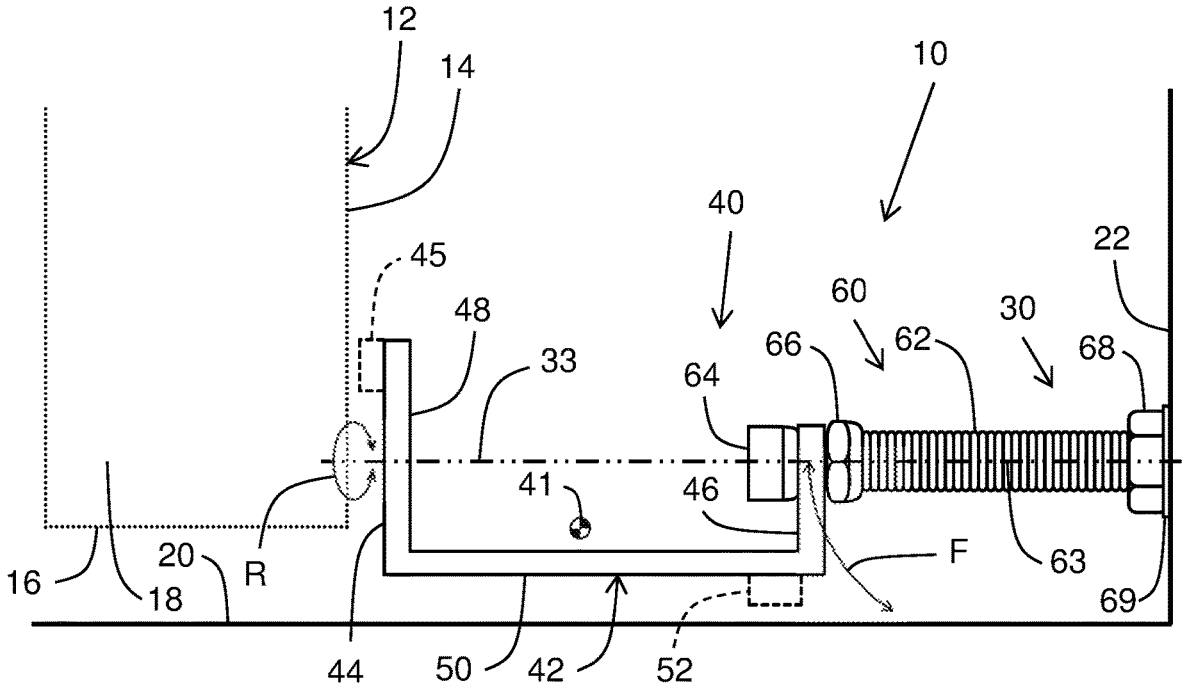
FIG. 1 is a front view of a door stopper and holder device in accordance with an embodiment of the present invention; showing the device in the operating configuration and in stopper mode, with a torsion-coil spring.
Figure 2:
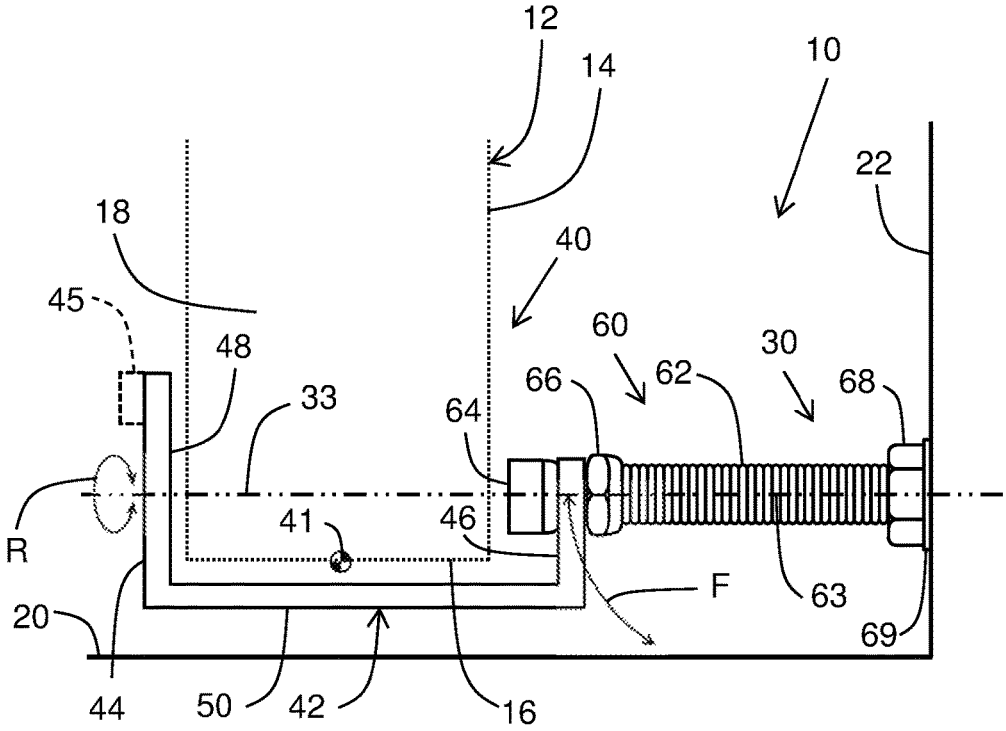
FIG. 2 is a view similar to FIG. 1, showing the device in the operating configuration and in holder mode.
Figure 3:
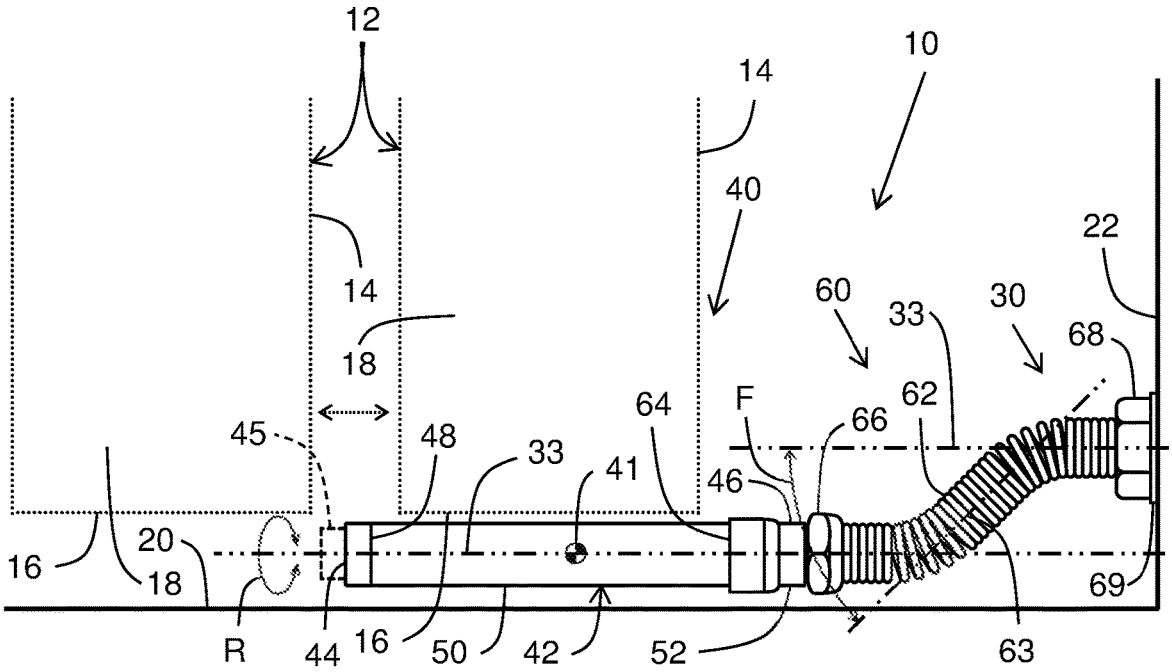
FIG. 3 is a view similar to FIG. 1, showing the device in the switching configuration, with the torsion-coil spring being slightly flexed and stretched.

In FIGS. 1 to 3, there is shown an embodiment 10 of a door stopper and holder device in accordance with the present invention. The device 10 operates with an adjacent door 12 (or window, or gate) when the door is in a door open position. The door 12 generally has a main body 14 defining a door plane, typically, as illustrated in the figures, the device 10 is located adjacent the bottom edge 16 (or surface) of the door close to the free lateral edge 18. A section of the device 10 is adapted to be selectively positioned within the free space between the bottom edge 16 of the door 12 and the underlaying floor surface 20 (the floor surface 20 beneath the door 12).

The device 10 comprises a distal part 30 for anchoring to a structure adjacent the door 12 when in the door open position, such as a wall 22 or the like, and a proximal part 40 movably mounted onto the distal part 30, and illustrated as being typically rotatably mounted onto the distal part 30 about a device axis 33, as indicated by arrow R. The device axis 33 is typically perpendicular to the wall 22 or other mounting surface.

As shown in FIGS. 1 to 3, the proximal part 40 is rotatable, typically using one's foot or hand (not shown), between an operating configuration (shown in both FIGS. 1 and 2) in either stopper mode (shown in FIG. 1) or holder mode (shown in FIG. 2) with the proximal part 40 being adapted to either be in abutment with the door 12 or capture the door 12 therewith in the door open position, respectively, and a switching configuration (shown in FIG. 3) in which the proximal part 40 is adapted to allow the door 12 to be moved relative to the device 10 as to switch between the stopper mode and the holder mode of the operating configuration. The device axis 33 is substantially perpendicular to the door plane when in the door open position and the proximal part 40 in the operating configuration.

The proximal part 40 is typically into an in-line position relative to the distal part 30 when in the operating configuration, and the device 10 further comprises a flexible resilient member 60 connecting to the distal part 30 and biasing the proximal part 40 into the in-line position. The flexible resilient member 60 allows the proximal part 40 to be selectively displaced into an angled position relative to the device axis 33, as indicated by arrow F, when in the switching configuration.

Typically, the flexible resilient member 60 is connected to both the proximal 40 and distal 30 parts and is located there between.

The flexible resilient member 60 of the embodiment of FIGS. 1 to 3 is a torsion-coil (or extension) spring 62 with a coil axis 63 being generally parallel to the device axis 33. The torsion-coil spring 62 also allows the rotation of the proximal part 40 relative to the distal part 30 about the device axis 33. In other words, the flexible resilient member 60 is a torsion-coil spring 62 having the coil axis 63 being generally colinear with the device axis 33 when in the operating configuration, and at a slight angle relative to, or parallel to the device axis 33 when in the switching configuration. Although the proximal part 40 is shown as being rotated clockwise when looking toward the wall 22 in FIG. 3, it is noted that the proximal part 40 could be rotated in any direction.

The proximal part 40 typically includes a door capturing section 42 (or cradle) that has a proximal free end 44 adapted to be in abutment with the door 12 when in the door open position and the device in the operating configuration in the stopper mode. The door capturing section 42 has a generally U-shaped body defining distal 46 and proximal 48 members both extending from a base member 50, generally in the upward direction, such that the U-shaped body 42 is generally vertically oriented when in the operating configuration. The base member 50 is generally spaced from and preferably parallel to the device axis 33, with both the distal 46 and proximal 48 members being substantially perpendicularly oriented relative to the device axis 33 and the base member 50. The distal 46 and proximal 48 members receive the door 12 there between when in the operating configuration and in the holder mode to releasably and safely capture the door 12. Although the distal 46 and proximal 48 members as well as the base member 50 are illustrated as having a generally rectilinear shape, any other shape could be considered without departing from the scope of the present invention.

The free end 44 typically includes a resilient bumper member 45 or the like, as represented in stippled lines in the figures, to absorb the hit (and noise) from the contact with the door 12, as well as preventing damage to the door 12. Although not illustrated, some sort of resilient bumper members could also be used inside the cradle 42, on both proximal 48 and distal 46 members, and on the screw head 64, to protect the surfaces of the door 12.

Similarly, to ensure that the door capturing section 42 always remains in the operating configuration, by default, the proximal part 40 has a center of gravity 41 (or center of mass) vertically offset from and below the device axis 33 and vertically offset therefrom (or vertically in-line therewith). Accordingly, the distal member 46 is freely rotatably mounted on a screw 64, secured into the torsion-coil spring 62, between the screwhead and a locknut 66 mounted onto the torsion-coil spring 62. At the distal end, the torsion-coil spring 62 is secured to the wall 22 via a nut 68 screwed on the torsion-coil spring 62 and secured to a washer 69 itself secured to the wall 22 using a wood screw (not shown) or the like.

Alternatively, the door capturing section 42 could be rigidly secured to the torsion-coil spring 62 and then, the torsion-coil spring 62 itself would allow the rotation of the door capturing section 42 bout the device axis 33. In another alternative, the torsion-coil spring 62 could be freely rotatably mounted onto the wall 22.

Figure 4:
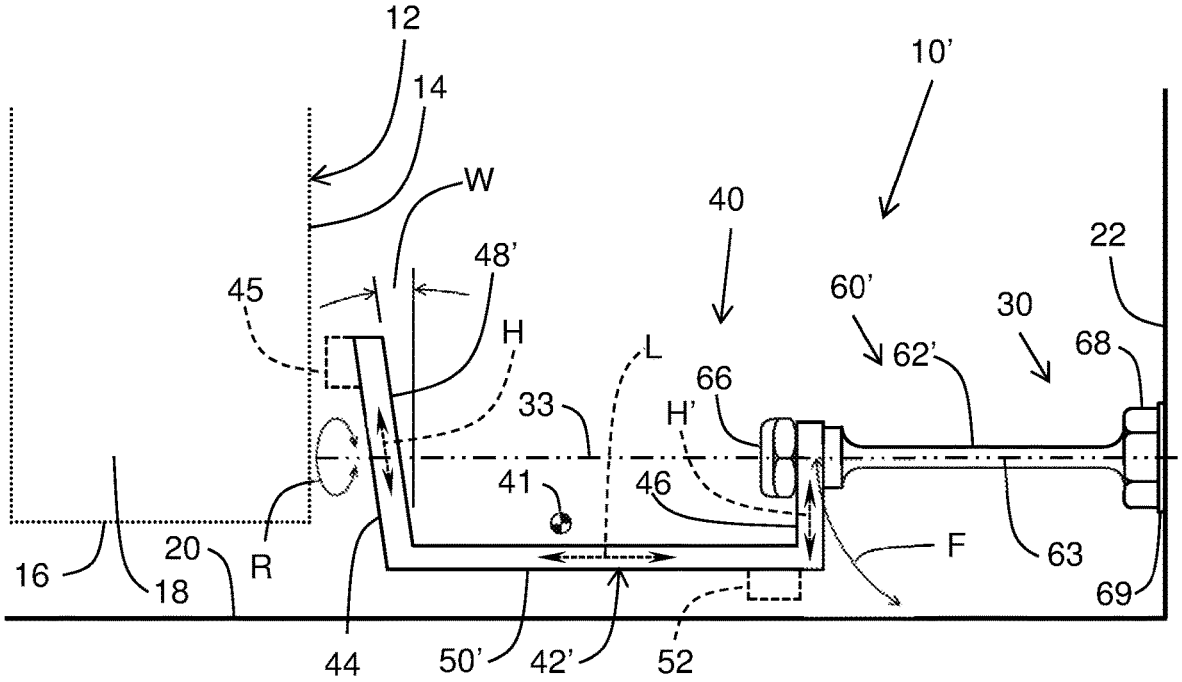
FIG. 4 is a view similar to FIG. 1 of another embodiment of a door stopper and holder device in accordance with the present invention, showing a door capturing section proximal part freely rotatably mounted on a flexible bar distal part.

As illustrated in stippled lines in FIGS. 1 and 4, the proximal part 40 could include and additional lump mass 52 at a proper location to help lower the center of gravity 41 relative to the device axis 33. The additional lump mass 52 could be either part of the proximal part 40 or be secured thereto via any well-known mechanical or chemical fastener.

Turning more specifically to FIG. 4, there is shown another embodiment 10' of a door stopper and holder device in accordance with the present invention. The proximal section 40 is freely rotatably mounted onto a flexible bar member 62' being the flexible resilient member 60' that allows the tilting of the proximal part 40 indicated by arrow F. Such a flexible bar member 62', or at least a portion thereof, could be made out of any plastic, rubber-based material, and even metallic material or the like known material(s).

The door capturing section 42' of the proximal part 40 is adjustable in size, such as the height of the proximal member 48' (as indicated by arrow H) and/or distal member 46 (as indicated by arrow H'), and/or in length with the base member 50' being adjustable in a length direction thereof (as indicated by arrow L) to adjust a distance between the distal 46 and proximal 48' members. Similarly, at least one of the distal 46 and proximal 48' members (and possibly both) could be slightly angled (any direction), preferably slightly extend in a direction away from (or also toward) the other one when extending away from the base member 50' (as indicated by angle W), as to provide for a wider (or narrower) opening of the U-shaped body 42' to allow for an easier capture of the door 12 therein. Similarly, although not specifically illustrated, the base member 50' could be slightly angled relative to the device axis 33 (and the floor surface 20) (or not exactly perpendicular to the adjacent wall 22), depending on the specific configuration or type of the door 12 and/or adjacent wall 22. In the latter case, both distal 46 and proximal 48' members could be either parallel to one another, although not perpendicular to the base member 50'.

Figure 5:
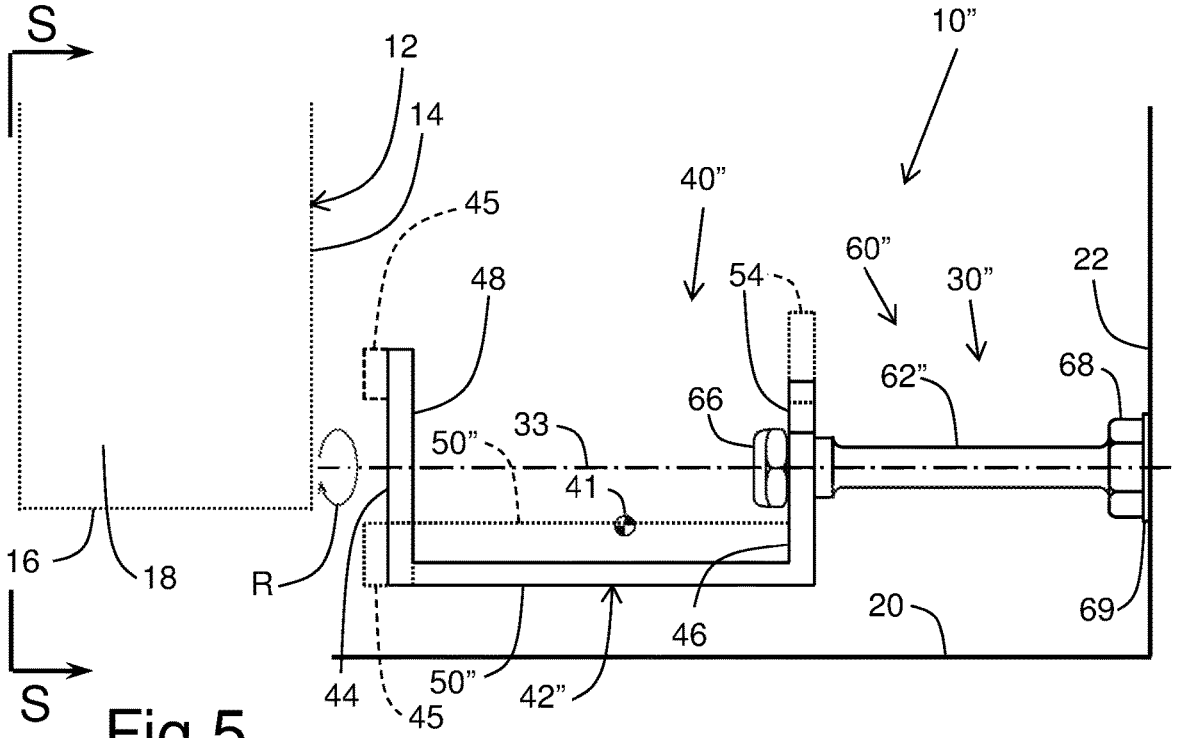
FIG. 5 is a view similar to FIG. 1 of another embodiment of a door stopper and holder device in accordance with the present invention, showing a door capturing section proximal part freely rotatably mounted on a rigid bar distal part, with the door capturing section in the operating configuration in solid lines and in the switching configuration in stippled lines.
Figure 6:
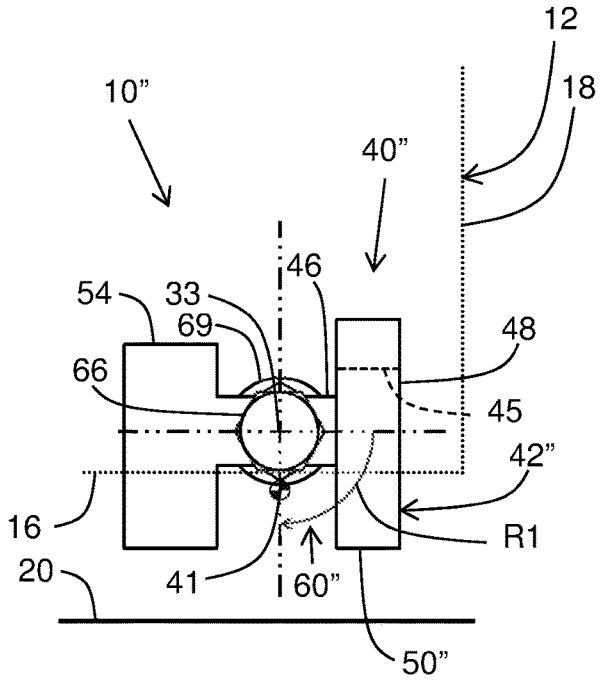
FIGS. 6 and 7 are left side views of the embodiment of FIG. 5, taken along line S-S of FIG. 5, showing door capturing section in the operating and switching configurations, respectively.
Figure 7:
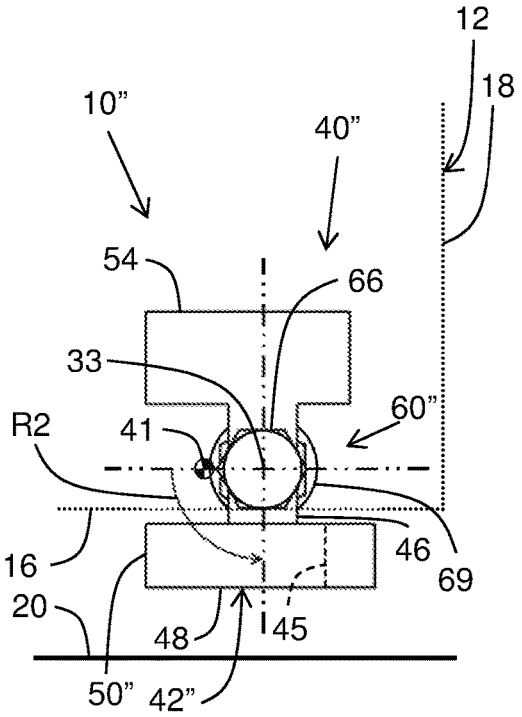

In FIGS. 5 to 7, there is shown another embodiment 10" of a door stopper and holder device in accordance with the present invention. The device 10" has the proximal part 40" that is freely rotatably mounted, about the device axis 33, onto a rigid bar member 62" of the rigid member 60" being part of the distal part 30" that is secured to the wall 22. Since the proximal part 40" cannot tilt relative to the device axis 33 when in the switching configuration, the door capturing section 42" is slightly laterally (horizontally) offset from the device axis 33 such that it can be positioned between the bottom edge 16 of the door 12 and the floor when rotated into the switching configuration, as illustrated in FIG. 7 (and in dotted lines in FIG. 5), from the operating configuration shown in FIGS. 5 and 6, as illustrated by arrow R1 of FIG. 6. Once the door has been moved 'above' the door capturing section 42", the latter is released and returns into the operating mode under the action of gravity on the center of gravity 41, as illustrated by arrow R2 of FIG. 7.

Accordingly, because of the lateral offset of the door capturing section 42" from the device axis 33, in order for the center of gravity 41 to be vertically in-line below the device axis 33 in the operating mode (see FIG. 6), the door capturing section 42" includes a counterweight 54 to the U-shaped body opposite the device axis 33, and secured to the distal member 46.

Figure 8:
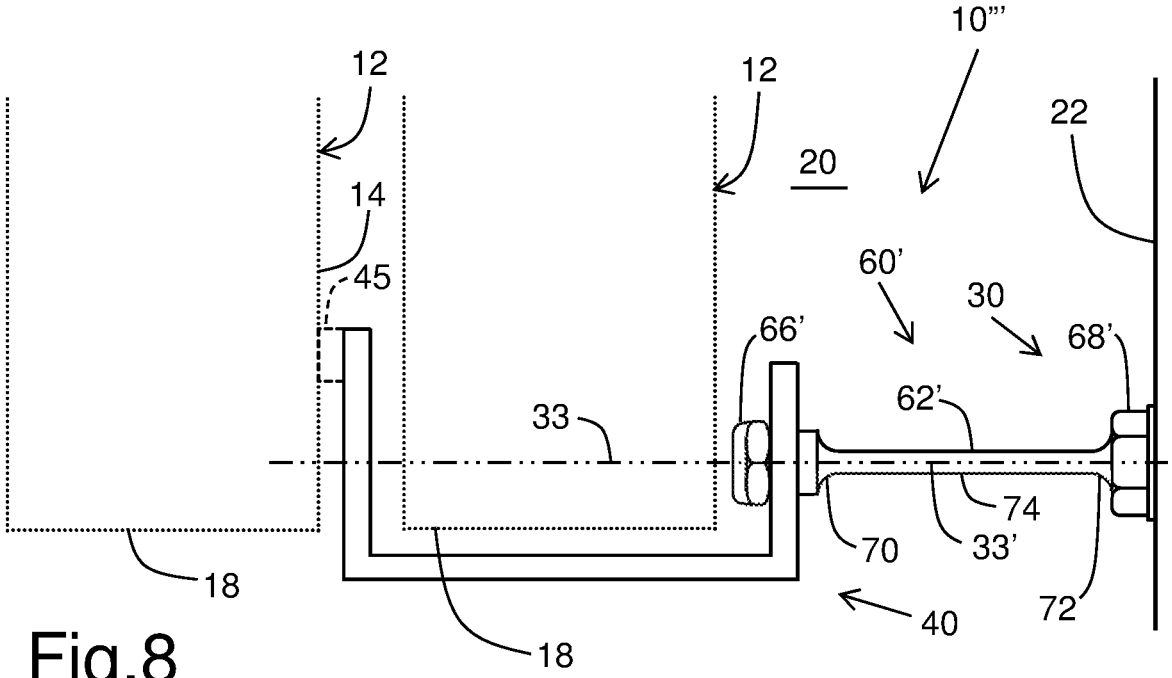
FIGS. 8 and 9 are top plan views of another embodiment of a door stopper and holder device in accordance with the present invention, showing the device, in the operating and switching configurations, respectively, with a proximal part movably mounted on a distal part via a flexible bar.
Figure 9:
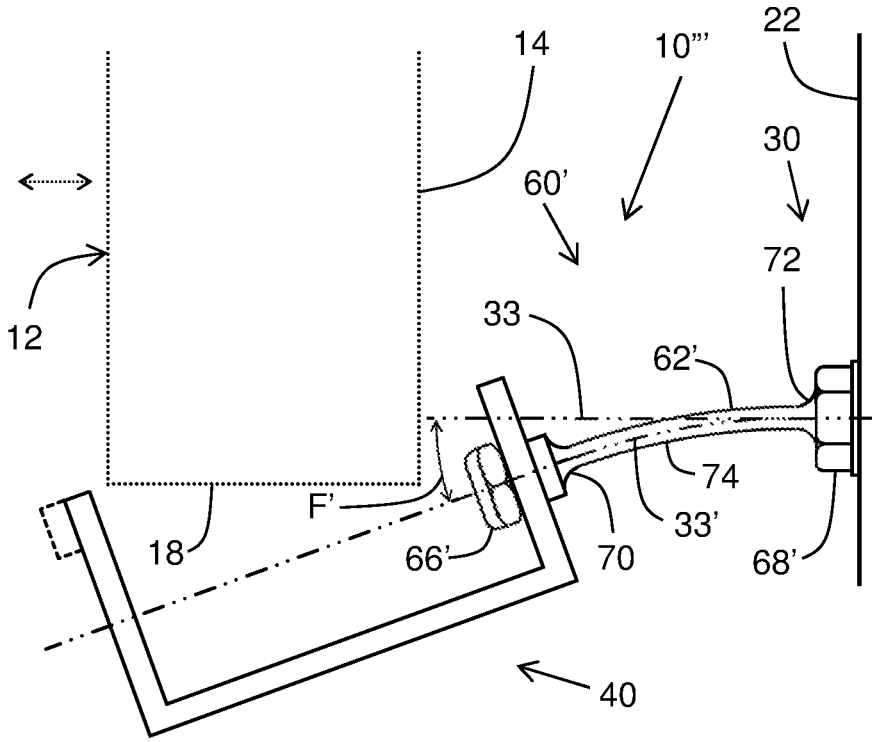

In FIGS. 8 and 9, there is shown another embodiment 10''' of a door stopper and holder device in accordance with the present invention, similar to the embodiment 10'. This embodiment 10''' is best suited when there is not enough room or space between the door 12 and the floor surface 20, or when it is difficult to properly secure the device 10''' on the wall 22 adjacent the floor surface 20. The device 10''' is mainly for use adjacent the free lateral edge 18 (as illustrated) or top edge of a door 12 or window. In this embodiment 10''', the proximal part 40 is movably mounted on the distal part 30 via a flexible resilient member 60', such as a flexible bar member 62' that allows the lateral (side) tilting of the proximal part 40 indicated by arrow F' and typically occurring under a force applied by a user's hand or the like. The proximal part 40, fixedly (or rigidly) attached to the proximal end 70 of the bar member 60' via a screw/nut arrangement 66' or the like, includes such proximal end 70, while the distal part 30 includes the distal end 72 of the bar member 60'. The flexible central portion 74 of the bar member 60' makes the flexible link between the two parts 30, 40. The distal part 30 is typically fixedly attached to the distal end 72 via a screw/nut arrangement 68' or the like.

FIG. 8 shows the embodiment 10''' in the operating configuration (with a rectilinear bar axis 33' in-line with the device axis 33) both in the stopper mode, with the door 12 of the left-hand-side position (in abutment with the bumper member 45), and in the holder mode, with the door 12 of the right-hand-side position. In order to switch between these two modes, a user's hand typically applies a force onto the device 10''' to make it tilt into the switching configuration (with a curved bar axis 33') shown in FIG. 9 enough to allow the passage of the door 12. After the body 14 of the door 12 is displaced, the resiliency of the bar member 62' ensures that it returns to its operating configuration upon removal of the applied force from the user.

Although not illustrated herein, one of ordinary skill in the art would readily understand that the door stopper and holder device of the present invention, including the embodiments 10, 10', 10", 10''', when applicable, could be easily modified to be able to operate adjacent a top edge or free lateral edge of a door or window.

Also, although not specifically discussed hereinabove, one of ordinary skill in the art would readily understand that all possible combinations of the above-described different features are included in the present invention, and that some additional features may be required for safety purpose and/or proper operation of the device.

Although the present invention has been described with a certain degree of particularity, it is to be understood that the disclosure has been made by way of example only and that the present invention is not limited to the features of the embodiments described and illustrated herein, but includes all variations and modifications within the scope of the invention as hereinabove described and hereinafter claimed.

The invention claimed is:

1. A door stopper and holder device for operating with a door when in a door open position, the door having a main body defining a door plane, the device comprising:

a distal part for anchoring to a structure adjacent the door when in the door open position; and a proximal part movably mounted on the distal part;

wherein the proximal part is movable between an operating configuration and a switching configuration, with a longitudinal device axis being perpendicular to the door plane when the door is in the door open position, the operating configuration comprises a stopper mode with the proximal part in abutment with the door in the door open position and a holder mode with the proximal part capturing the door therein in the door open position, and the switching configuration comprises wherein the proximal part is adapted to allow the door to be moved relative to the device when switching between the stopper mode and the holder mode of the operating configuration;

wherein the proximal part is rotatably mounted on the distal part about the device axis, with the proximal part being rotatable about the device axis between the operating configuration and the switching configuration.

2. The device of claim 1, wherein the proximal part includes a door capturing section having a proximal end adapted to be in abutment with the door when in the door open position.

3. The device of claim 2, wherein the door capturing section has a U-shaped body defining distal and proximal members both extending from a base member, the base member being spaced from the device axis, with both the distal and proximal members being perpendicularly oriented relative to the device axis, the distal and proximal members receiving the door therebetween when in the holder mode of the operating configuration to releasably capture the door.

4. The device of claim 2, wherein the proximal part is in an in-line position relative to the distal part when in the operating configuration, the device further comprising a flexible resilient member connecting to the distal part and biasing the proximal part into the in-line position, while allowing the door capturing section to be selectively displaced into an angled position relative to the device axis when in the switching configuration.

5. The device of claim 4, wherein the flexible resilient member is connected to both the proximal and distal parts and is located therebetween.

6. The device of claim 5, wherein the flexible resilient member is a torsion-coil spring having a coil axis parallel to the device axis.

7. The device of claim 6, wherein the torsion-coil spring allows the rotation of the proximal part relative to the distal part about the device axis.

8. The device of claim 5, wherein the flexible resilient member is a torsion-coil spring having a coil axis colinear with the device axis.

9. The device of claim 3, wherein the base member is parallel to the device axis, with both the distal and proximal members being perpendicularly oriented relative to the base member.

10. The device of claim 2, wherein the door capturing section has a U-shaped body defining distal and proximal members both extending from a base member, the base member being spaced from the device axis, the distal and proximal members receiving the door therebetween when in the holder mode of the operating configuration to releasably capture the door; and wherein the U-shaped body is vertically oriented when in the operating configuration.

11. The device of claim 10, wherein the U-shaped body is adjustable in size.

12. The device of claim 10, wherein the base member is adjustable in a length direction thereof so as to adjust a distance between the distal and proximal members.

13. The device of claim 10, wherein one of the distal and proximal members slightly extends away from the other one of the distal and proximal members when extending away from the base member.

14. The device of claim 13, wherein the distal and proximal members slightly extend away from one another when extending away from the base member.

15. The device of claim 2, wherein the proximal part has a center of gravity offset from the device, the center of gravity maintaining the proximal part into the operating configuration about the device axis.

16. The device of claim 2, wherein the proximal part is freely rotatably mounted onto the distal part about the device axis.

* * * * *